US009651892B2

(12) United States Patent
Hirai

(10) Patent No.: US 9,651,892 B2
(45) Date of Patent: May 16, 2017

(54) WET-TYPE IMAGE FORMING APPARATUS

(71) Applicant: Konica Minolta, Inc., Chiyoda-ku (JP)

(72) Inventor: Atsuto Hirai, Ikoma (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/270,486

(22) Filed: May 6, 2014

(65) Prior Publication Data

US 2014/0334837 A1 Nov. 13, 2014

(30) Foreign Application Priority Data

May 8, 2013 (JP) ..... 2013-098290

(51) Int. Cl.

| | |
|---|---|
| ***G03G 15/10*** | (2006.01) |
| ***G03G 15/06*** | (2006.01) |
| ***G03G 15/02*** | (2006.01) |
| ***G03G 15/00*** | (2006.01) |

(52) U.S. Cl.

CPC ..... *G03G 15/065* (2013.01); *G03G 15/0266* (2013.01); *G03G 15/0283* (2013.01); *G03G 15/105* (2013.01); *G03G 15/5033* (2013.01)

(58) Field of Classification Search

CPC ..... G03G 15/10; G03G 15/105
USPC ..... 399/55, 237–239
See application file for complete search history.

(56) References Cited

U.S. PATENT DOCUMENTS

| | | | | |
|---|---|---|---|---|
| 6,160,569 | A * | 12/2000 | Fujimori et al. | 347/262 |
| 2005/0141925 | A1* | 6/2005 | Kim | G03G 15/0812 399/281 |
| 2005/0180766 | A1* | 8/2005 | Shin et al. | 399/55 |
| 2007/0140737 | A1 | 6/2007 | Takano et al. | |
| 2008/0069579 | A1* | 3/2008 | Tabata | G03G 15/169 399/53 |
| 2010/0054770 | A1* | 3/2010 | Yamane | G03G 15/065 399/44 |
| 2011/0249990 | A1* | 10/2011 | Izawa | G03G 15/104 399/238 |

FOREIGN PATENT DOCUMENTS

| | | | |
|---|---|---|---|
| JP | 9-211994 | A | 8/1997 |
| JP | 11-65289 | A | 3/1999 |
| JP | 2003-228242 | A | 8/2003 |
| JP | 2004-286859 | A | 10/2004 |

(Continued)

OTHER PUBLICATIONS

Japanese Notice of Grounds of Rejection dated May 7, 2015 issued in the corresponding Japanese Patent Application No. 2013-098290 and English translation (8 pages).

*Primary Examiner* — Minh Phan

(74) *Attorney, Agent, or Firm* — Buchanan Ingersoll & Rooney PC

(57) ABSTRACT

A supply member of this wet type image forming apparatus has a surface rotating in a direction the same as a surface of a developer carrier at the same peripheral velocity at a portion abutting to the developer carrier. A control unit causes toner particles on the supply member to move to the developer carrier by providing a potential difference between the developer carrier and the supply member and controls an amount of toner particles on a latent image carrier by controlling electric power of a first charging member.

7 Claims, 6 Drawing Sheets

(56) References Cited

FOREIGN PATENT DOCUMENTS

| | | | | |
|---|---|---|---|---|
| JP | 2005-234430 | A | | 9/2005 |
| JP | 2007-155999 | A | | 6/2007 |
| JP | 2008-83133 | A | | 4/2008 |
| JP | 2008-299065 | A | | 12/2008 |
| JP | 2011175197 | A | * | 9/2011 |
| JP | 2012-68372 | A | | 4/2012 |
| WO | WO 94/16364 | A1 | | 7/1994 |

* cited by examiner

FIG.3
| | | SUPPLY ROLLER VOLTAGE(V) | | | |
|---|---|---|---|---|---|
| | | 500 | 600 | 700 | 800 |
| CURRENT WHICH FLOWS INTO SUPPLY ROLLER(μA) | 220 | × | × | ○ | ○ |
| | 330 | × | × | ○ | ○ |
| | 440 | × | × | ○ | ○ |
○: CASE THAT FILM THICKNESS OF TONER ON DEVELOPMENT ROLLER IS UNIFORM
×: CASE THAT FILM THICKNESS OF TONER ON DEVELOPMENT ROLLER IS NON-UNIFORM
FIG.4
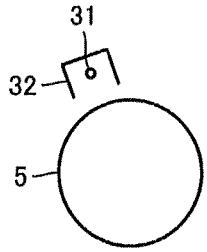
FIG.5
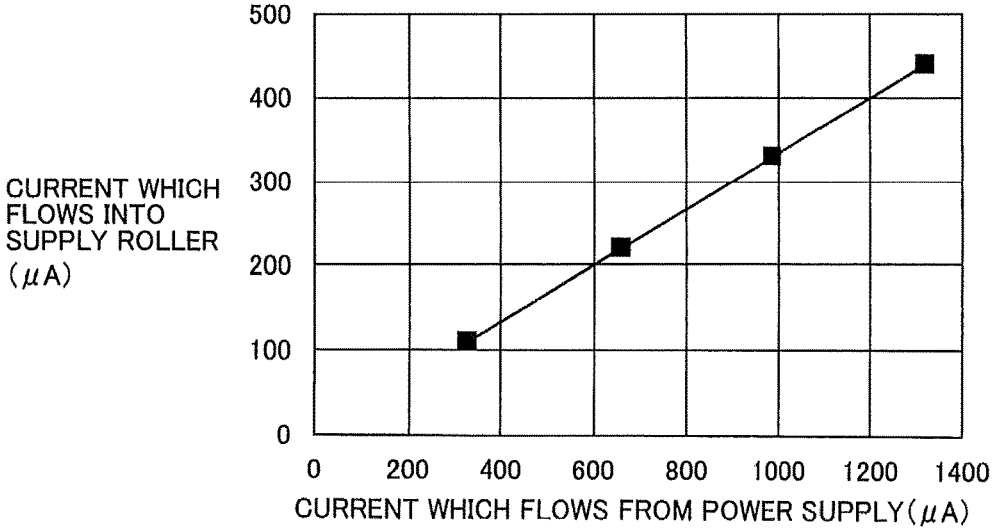

WET-TYPE IMAGE FORMING APPARATUS

This application is based on Japanese Patent Application No. 2013-098290 filed with the Japan Patent Office on May 8, 2013, the entire content of which is hereby incorporated by reference.

BACKGROUND OF THE INVENTION

Field of the Invention

The present invention relates to a printer, a copying machine, a facsimile machine, and other electrophotographic image forming apparatuses and particularly to a wet type image forming apparatus adopting wet development as a development scheme.

Description of the Related Art

In wet development, an amount of toner particles formed on a photoconductor should be controlled depending on a type of paper. Specifically, an amount of toner particles may be small when a surface of paper is smooth as in coated paper. When a surface of paper is rough as in bond paper, a necessary amount of toner particles is large for covering a surface (irregularities) of paper.

For example, when an amount of toner particles as much as that for coated paper is used for printing on bond paper, an amount of toner particles covering a surface of bond paper is short and quality of an image printed on bond paper is lowered. Thus, in order to prevent lowering in image quality, an amount of toner particles on a photoconductor is changed depending on a type of paper and an amount of toner particles for adhesion onto paper is controlled.

The following two methods are available for control of an amount of toner particles on a photoconductor. A first method is a method of controlling an amount of toner particles to be moved to a photoconductor during development after a layer of a prescribed amount of toner particles is formed on a development roller. A second method is a method of controlling an amount of toner particles on a development roller.

Japanese Laid-Open Patent Publications Nos. 2012-068372, 2008-299065, 2008-083133, 2007-155999, 2005-234430, 2004-286859, 2003-228242, 11-065289, and 09-211994 are exemplified as documents disclosing a technique for controlling an amount of toner particles on a development roller.

SUMMARY OF THE INVENTION

The first method can achieve control by changing a difference in development potential which is applied during development as in dry electrophotography. When a difference in development potential is decreased in order to decrease an amount of toner particles on a photoconductor, however, influence by disturbance (rivulets) of a solution at a nip exit between a development roller and the photoconductor is likely. Consequently, a thickness of a toner layer formed on the photoconductor becomes non-uniform.

By controlling an amount of charge of toner on a development roller, an amount of toner particles developed on a photoconductor can be controlled even when a difference in development potential is constant. In order to decrease an amount of toner particles on the photoconductor, an amount of charge of toner on the development roller should be increased.

When an amount of charge of toner is increased while an amount of toner particles on a development roller is large, however, a potential of a toner layer becomes high. Consequently, an image (development) is produced also in a background portion (occurrence of fogging). In order to prevent fogging of a background portion while a potential of the toner layer is high, a potential difference of the background portion should be large and it becomes difficult to achieve also a difference in development potential.

The second method provides a supply roller supplying a developer to a development roller, controls a ratio (θ) of a peripheral velocity of the supply roller to the development roller, and controls an amount of toner particles on the development roller. A direction of rotation of the supply roller is either counter rotation of rotation in a direction opposite to a development roller or with rotation which is rotation in the same direction, at a portion of nipping together with (a portion abutting to) the development roller. In any rotation direction, an amount of toner particles on a development roller can be controlled by controlling a ratio (θ) of a peripheral velocity.

Both of counter rotation of rotation in a direction opposite to the development roller and with rotation which is rotation in the same direction, however, suffer from friction owing to difference in velocity between rollers, which results in increase in torque and/or shorter life of members. If toner particles are moved to the development roller without application of electric field in with rotation, uniformity of a thickness of a toner layer formed on the development roller may disadvantageously be impaired due to disturbance (rivulets) of a wet type developer (solution) at a nip exit as in development onto a photoconductor.

In order to suppress occurrence of this problem, in with rotation, a velocity is not differed between a development roller and a supply roller (θ=1) and a potential difference not smaller than certain magnitude is provided between the supply roller and the development roller, to thereby provide force attracting toner particles to the development roller. Thus, even when disturbance of a wet type developer (solution) takes place at the nip exit, a toner layer of a uniform thickness can be formed without the toner layer on the development roller being affected. Similar control is carried out also when a ratio (θ) of a peripheral velocity is set.

In counter rotation, a wet type developer does not pass the nip and no disturbance of the wet developer (solution) takes place. Therefore, it is not necessary to form electric field.

When a potential difference is made smaller in order to decrease an amount of toner particles on a development roller, however, adhesive force of toner particles to the development roller at the nip exit lowers and influence by disturbance of the wet type developer (solution) is likely as in development onto the photoconductor. Then, uniformity of a film thickness of a toner layer on the development roller is impaired.

The present invention was made in view of the problems above, and an object thereof is to provide a wet type image forming apparatus capable of controlling an amount of toner particles on a photoconductor while occurrence of increase in torque and deterioration of members is prevented and a toner layer of a uniform film thickness is formed in the wet type image forming apparatus.

A wet type image forming apparatus according to the present invention is a wet type image forming apparatus for printing on a transfer target by using a wet type developer containing toner particles, and it includes a developer carrier supplying the wet type developer to a latent image carrier having an electrostatic latent image formed, a supply member supplying the wet type developer to the developer carrier, a first charging member charging the toner particles in a wet type developer layer formed by the wet type developer on the supply member, and a control unit controlling a potential difference between the developer carrier and the supply member and output of the first charging member.

The supply member has a surface rotating in a direction the same as a surface of the developer carrier at the same peripheral velocity at a portion abutting to the developer carrier, and the control unit causes the toner particle on the supply member to move to the developer carrier by providing a potential difference between the developer carrier and the supply member and controls an amount of toner particles on the latent image carrier by controlling output of the first charging member.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 3 is a diagram showing relation between a supply roller voltage and a current which flows into a supply roller of the wet type image forming apparatus in the first embodiment.

FIG. 4 is a schematic diagram showing a structure of a first charging member adopted in the wet type image forming apparatus in the first embodiment.

FIG. 5 is a diagram showing relation between a current which flows from a power supply of the first charging member adopted in the wet type image forming apparatus in the first embodiment and a current which flows into the supply roller.

DESCRIPTION OF THE PREFERRED EMBODIMENTS

Figure 1:
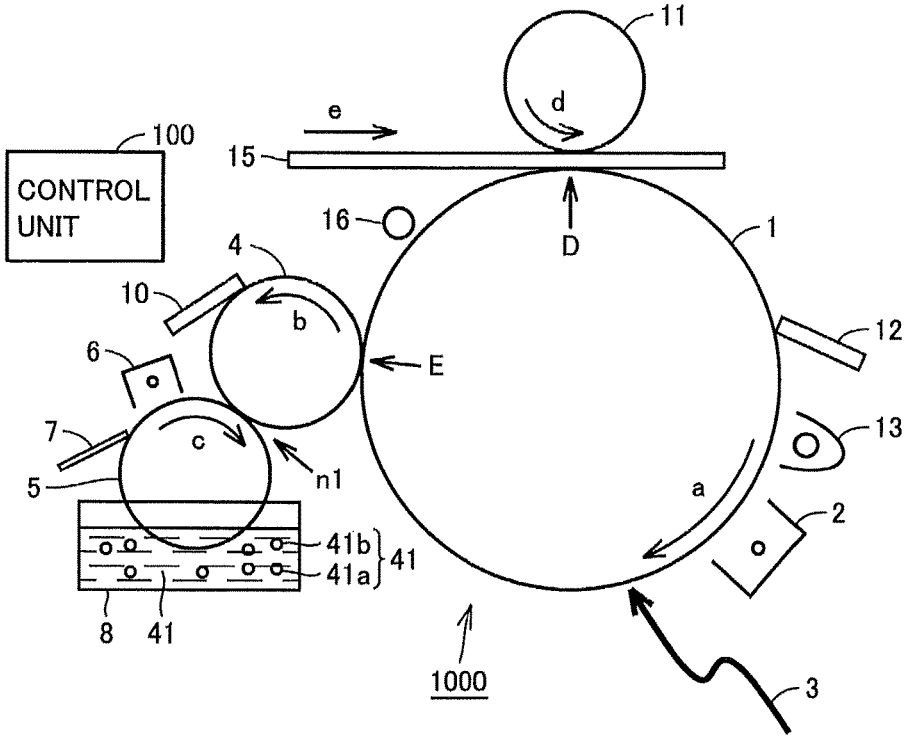
FIG. 1 is a diagram schematically showing an overall construction of a wet type image forming apparatus in a first embodiment.

A wet type image forming apparatus in an embodiment based on the present invention will be described hereinafter with reference to the drawings. When the number, an amount or the like is mentioned in each embodiment described below, the scope of the present invention is not necessarily limited to the number, the amount or the like, unless otherwise specified. The same or corresponding elements have the same reference characters allotted and redundant description may not be repeated.

Combination for use of features in embodiments as appropriate is originally intended. In an electrophotography process shown below, a wet type image forming apparatus including photoconductors for 4 colors (multiple colors) is also applicable.

First Embodiment

Wet Type Image Forming Apparatus 1000

A wet type image forming apparatus 1000 will be described with reference to FIG. 1. FIG. 1 is a diagram schematically showing an overall construction of wet type image forming apparatus 1000 in the present embodiment. A photoconductor 1 which is a latent image carrier rotates in a direction a in the figure and charged to an even potential by a charging apparatus 2. Photoconductor 1 is exposed to an exposure apparatus 3 after being charged, a potential at an image portion is attenuated, and an electrostatic latent image is formed.

Photoconductor 1 on which an electrostatic latent image has been formed is carried to a development portion E which is a portion opposed to a development roller 4 which is a developer carrier. In development portion E, a wet type developer 41 on development roller 4 comes in contact with photoconductor 1. Wet type developer 41 contains toner particles 41*a* composed of a coloring agent and a resin and a dispersant (carrier solution) 41*b* in which these toner particles 41*a* have been dispersed.

Toner particles 41*a* on development roller 4 have been charged. In a print portion on photoconductor 1, toner particles 41*a* move to photoconductor 1, and in a background portion, they move to development roller 4. Toner particles 41*a* developed on photoconductor 1 are carried to a transfer portion P which is a portion opposed to a transfer roller 11 rotating in a direction d in the figure. In transfer portion P, a transfer target (paper) 15 is conveyed in a direction shown with an arrow e.

A voltage reverse in polarity to toner particles 41*a* which was applied to transfer roller 11 causes transfer of toner particles 41*a* on photoconductor 1 onto transfer target 15. Transfer target 15 to which toner particles 41*a* have been transferred is conveyed to a fixing portion (not shown) so that a toner image is fixed.

A cleaning blade 12 is provided on photoconductor 1 which has passed transfer portion P. Cleaning blade 12 recovers toner particles 41*a* and carrier solution 41*b* which have remained on photoconductor 1 after transfer. Photoconductor 1 from which toner particles 41*a* and carrier solution 41*b* have been recovered is exposed to an eraser lamp 13 so that a latent image potential is canceled.

Toner particles 41*a* and carrier solution 41*b* which remain without being developed are present also on development roller 4 which has passed development portion E. In order to remove them, a cleaning blade 10 is provided on development roller 4. By repeating these steps, images are successively printed on transfer target (paper) 15.

Development portion E will now be described in detail. Wet type developer 41 containing toner particles 41*a* having a coloring agent and a resin and dispersant (carrier solution) 41*b* in which toner particles 41*a* are dispersed is stored in a developer tank 8.

A supply roller 5 implementing a supply member is partially immersed in wet type developer 41 and rotates in a direction c in the figure. As supply roller 5 rotates, wet type developer 41 is brought up. A restriction blade 7 provided as abutting to supply roller 5 restricts wet type developer 41 to a constant film thickness at a surface of supply roller 5.

As supply roller 5 rotates, wet type developer 41 is conveyed to a portion opposed to a first charger 6 implementing a first charging member and toner particles 41*a* in wet type developer 41 are charged by a current which flows from first charger 6 to supply roller 5. After first charger 6 is provided and toner particles 41*a* are charged, toner particles 41*a* are moved to development roller 4 owing to a potential difference. Thus, influence by disturbance of wet type developer 41 is eliminated so that a wet type developer layer (toner layer) of a uniform thickness can be formed on development roller 4.

Wet type developer 41 charged by first charger 6 moves to a portion n1 of nipping together with development roller 4. Development roller 4 abuts to supply roller 5 and a surface of development roller 4 rotates in a direction the same as the surface of supply roller 5 (a direction b in the figure) at the same velocity at nip portion n1. As a result of rotation in the same direction at the same velocity, slide friction between development roller 4 and supply roller 5 is not present, torque is small, and wear and deterioration of members can be suppressed.

Such electric field as moving toner particles 41*a* to development roller 4 is formed between development roller 4 and supply roller 5, and toner particles 41*a* which have entered portion n1 of nipping together with development roller 4 owing to electric field move from the surface of supply roller 5 to the surface of development roller 4.

A toner layer of a small film thickness formed on development roller 4 owing to electric field abuts to photoconductor 1 as development roller 4 rotates, and develops an electrostatic latent image on photoconductor 1. Wet type developer 41 which has remained on development roller 4 without being used for development is recovered by cleaning blade 10.

Since wet type developer 41 recovered by cleaning blade 10 is different in toner density from original wet type developer 41, it is recovered in a tank (not shown) different from developer tank 8. After toner density is adjusted, wet type developer 41 is again returned to developer tank 8.

For supply roller 5, a roller made of urethane, a rubber roller made of NBR (nitrile butadiene rubber), or an anilox roller provided with recesses in a surface can be employed. For development roller 4, a roller made of urethane or a rubber roller made of NBR can be employed.

Development roller 4 may be coupled to a drive apparatus and supply roller 5 may follow development roller 4.

(Wet Type Developer 41)

Wet type developer 41 will now be described. Coarsely crushed toner particles are employed as toner particles 41*a*. Coarsely crushed toner particles are manufactured by sufficiently mixing 100 parts of polyester resin and 15 parts of copper phthalocyanine in a Henschel mixer (trademark) and thereafter performing melting and mixing and kneading by using a co-rotation twin-screw extruder at an in-roll heating temperature of 100° C. The resultant mixture is cooled and coarsely crushed to thereby obtain coarsely crushed toner particles.

According to a method of manufacturing wet type developer 41, wet type developer 41 was obtained by mixing 75 parts of IPS2028 (manufactured by Idemitsu Kosan Co., Ltd.), 25 parts of coarsely crushed toner, and 0.8 part of V216 (manufactured by ISP Inc.) serving as a dispersant and wet crushing the mixture for 4 days by using a sand mill. A particle size of coarsely crushed toner particles at that time was 2.0 μm. A particle size of coarsely crushed toner particles was measured with a laser diffraction particle size analyzer SALD-2200 (manufactured by Shimadzu Corporation).

A control unit 100 rotates and drives development roller 4, supply roller 5, and photoconductor 1, controls a potential of development roller 4 and supply roller 5, controls a value for a current which flows from first charger 6 to supply roller 5, and controls exposure apparatus 3, eraser lamp 13, and charging apparatus 2.

(Control of Amount of Toner Particles 41*a* on Photoconductor 1)

Control of an amount of toner particles 41*a* on photoconductor 1 will now be described. A controlled variable for toner particles 41*a* is calculated in control unit 100 and a parameter of each component is set as shown below.

An amorphous silicon (a-Si) photoconductor drum was employed as photoconductor 1. Photoconductor 1 is evenly charged to 650 V by charging apparatus 2. In photoconductor 1, a print portion of an image is exposed to exposure apparatus 3 and a potential thereof is lowered to 20 V.

A voltage of 400 V is applied to development roller 4 in order to develop toner particles 41*a* on development roller 4 onto photoconductor 1. By doing so, toner particles 41*a* on development roller 4 corresponding to a print portion of an image move to photoconductor 1 (see "no charger on development roller" in FIG. 10).

Toner particles 41*a* in wet type developer 41 formed to a uniform thin layer on supply roller 5 are not charged in that state, but they are charged by a current which flows from first charger 6 into supply roller 5. A voltage for moving charged toner particles 41*a* on supply roller 5 to development roller 4 is applied to supply roller 5 at nip portion n1.

Figure 2:
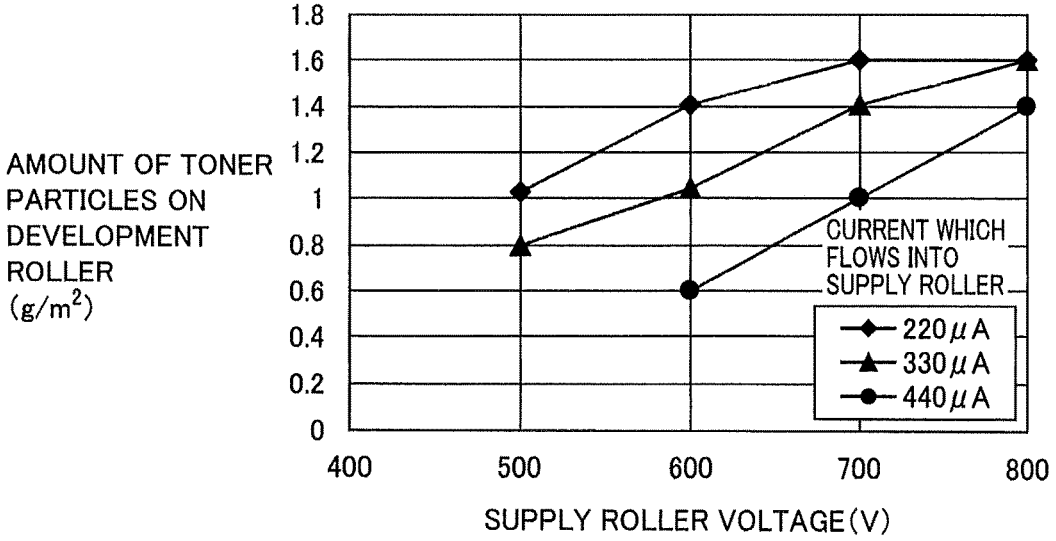
FIG. 2 is a diagram showing relation between a supply roller voltage and an amount of toner particles on a development roller of the wet type image forming apparatus in the first embodiment.

FIG. 2 shows relation between a voltage applied to supply roller 5 and an amount of toner particles on development roller 4 at the time when a current which flows from first charger 6 into supply roller 5 is varied. FIG. 3 shows evaluation of uniformity of a toner layer on development roller 4 at that time.

A rubber roller made of polyurethane of which rubber layer thickness is 6 mm and diameter ϕ is 40 mm was employed as supply roller 5. A roller having a polyurethane resin as a surface layer on polyurethane rubber, of which rubber layer thickness is 10 mm and diameter ϕ is 40 mm, was employed as development roller 4.

Supply roller 5 has volume resistance of $10^7$ Ω·cm and development roller 4 has volume resistance of $10^8$ Ω·cm. First charger 6 has a width (a width along a direction of extension of a rotation axis of supply roller 5) of 21 cm. Supply roller 5 and development roller 4 rotate at a velocity of 420 mm/sec. while a distance between axial centers is reduced by pressing by 0.1 mm (a distance between axial centers of 39.9 mm).

An experiment was conducted while a voltage of 400 V which was the same as in development was applied to development roller 4 and a voltage applied to supply roller 5 was varied. While a voltage was applied to supply roller 5 and development roller 4 and first charger 6 was also caused to provide output, supply roller 5 and development roller 4 were driven for 5 seconds and an amount of developer on development roller 4 after it was stopped and an amount of toner particles were found.

An amount of developer can be found by wiping off wet type developer 41 over a certain area and measuring a mass. A mass only of toner particles 41*a* can be found by heating the wiped sample in a constant temperature bath at 100 degrees for drying carrier solution 41*b*. An amount of a developer on supply roller 5 was 6.4 g/m$^2$ and an amount of toner particles therein was 1.6 g/m$^2$.

As shown in FIG. 2, regardless of a current which flows from first charger 6 into supply roller 5, when a voltage of supply roller 5 increases and a difference in potential from development roller 4 is greater, an amount of toner particles on development roller 4 increases.

In contrast, when a voltage is lower, an amount of toner particles 41*a* on development roller 4 decreases. When a voltage of supply roller 5 is set to 500 V while a flow-in current is set to 220 μA (difference in potential of 100V), an amount of toner particles 41*a* on development roller 4 is 1.0 g/m$^2$, and when a voltage is set to 700 V, an amount is 1.6 g/m$^2$. When a voltage is equal to or higher than 700 V, toner particles 41*a* on supply roller 5 all moved onto development roller 4 and hence an amount of toner particles on development roller 4 is constant at 1.6 g/m$^2$.

When a voltage of supply roller 5 is set to 500 V while a flow-in current is set to 330 μA, an amount of toner particles 41*a* on development roller 4 is 0.8 g/m$^2$, and when a voltage is 800 V or higher, an amount is 1.6 g/m$^2$. When a flow-in current is increased further to 440 μA and when a voltage of supply roller 5 is set to 700 V, an amount of toner particles 41*a* on development roller 4 is 1.0 g/m$^2$, and when a voltage is set to 800V, an amount is 1.4 g/m$^2$.

As is clear from FIG. 2, by increasing a current which flows from first charger 6 into supply roller 5, an amount of toner particles on development roller 4 can be decreased even though a voltage of supply roller 5 is constant.

In FIG. 3, when a voltage of supply roller 5 is equal to or lower than 600 V, influence by disturbance of a solution at a nip exit between supply roller 5 and development roller 4 is likely and a film thickness of a toner layer on development roller 4 may become non-uniform.

By controlling a voltage of supply roller 5 to 700 V and controlling a current which flows from first charger 6 into supply roller 5 between 220 μA or higher and 440 μA or lower, a film thickness of a toner layer can be maintained in a uniform state. In addition, an amount of toner particles on development roller 4 can be controlled in a range from 1 g/m$^2$ or more and 1.6 g/m$^2$ or less.

By applying a sufficient difference (400 V) in development potential to development roller 4, toner on development roller 4 is substantially entirely developed on photoconductor 1. Consequently, when an amount of toner particles 41*a* on development roller 4 varies, an amount of toner particles 41*a* on photoconductor 1 also varies.

In the present embodiment, for coated paper of which surface is smooth, a current which flows from first charger 6 into supply roller 5 is set to 440 μA and an amount of toner particles on photoconductor 1 is set to 1 g/m$^2$ so that a uniform image is obtained on the paper.

For bond paper of which surface is rough, a current which flows from first charger 6 into supply roller 5 is set to 220 μA and an amount of toner particles on photoconductor 1 is set to 1.6 g/m$^2$ so that a uniform image is obtained on the paper. An amount of toner particles in between the above (an amount of adhesion of toner) can also be set depending on a type of paper.

By thus varying a current which flows from first charger 6 into supply roller 5 and varying an amount of toner particles 41 on photoconductor 1 depending on a type of paper, a uniform image can be formed regardless of a type of paper.

FIG. 4 shows a construction of first charger 6. In first charger 6, a casing 32 is provided around a wire 31. Casing 32 is connected to the ground (not shown). Consequently, a current from wire 31 flows into supply roller 5 and casing 32. Wire 31 is connected to a power supply (not shown). A current which flows from the power supply and a current which flows into supply roller 5 satisfy proportional relation as shown in FIG. 5. By adjusting a current which flows from the power supply, a current which flows from first charger 6 into supply roller 5 can be controlled. A current which flows into supply roller 5 may be controlled by controlling a voltage of the power supply.

As another form, an amount of toner particles 41*a* on photoconductor 1 may be sensed by providing an optical toner adhesion amount sensor 16 (see FIG. 1) on photoconductor 1. This toner adhesion amount sensor 16 senses an amount of adhesion of toner particles 41*a* on photoconductor 1 between transfer portion P where an image formed on photoconductor 1 is transferred onto paper and development portion E where wet type developer 41 is supplied from development roller 4 to photoconductor 1.

A result of sensing by toner adhesion amount sensor 16 is sent to a CPU of control unit 100 and compared with data on a reference value for an amount of toner particles on a photoconductor recorded in advance (hereinafter referred to as a reference value). The CPU records reference values in accordance with types of paper, and a reference value in accordance with a type is set based on input from a sensor sensing a type of paper or from an operator.

When it is determined that an amount of adhesion of toner particles 41*a* on photoconductor 1 is smaller than a reference amount as a result of sensing by toner adhesion amount sensor 16, control is carried out such that a current which flows from first charger 6 into supply roller 5 decreases. In contrast, when it is determined that an amount of adhesion of toner particles is greater than a reference amount, control is carried out such that a current which flows from first charger 6 into supply roller 5 increases.

By controlling an amount of adhesion of toner particles 41*a* on photoconductor 1 by using toner adhesion amount sensor 16, an amount of adhesion of toner particles 41*a* on photoconductor 1 can accurately be adjusted even though an amount of wet type developer 41 on supply roller 5 fluctuates due to change in environment or development efficiency varies due to fluctuation of photoconductor 1.

An operator can also manually control density by looking at density of an image. A current which flows from first charger 6 into supply roller 5 should only be controlled in accordance with a set value.

Figure 6:
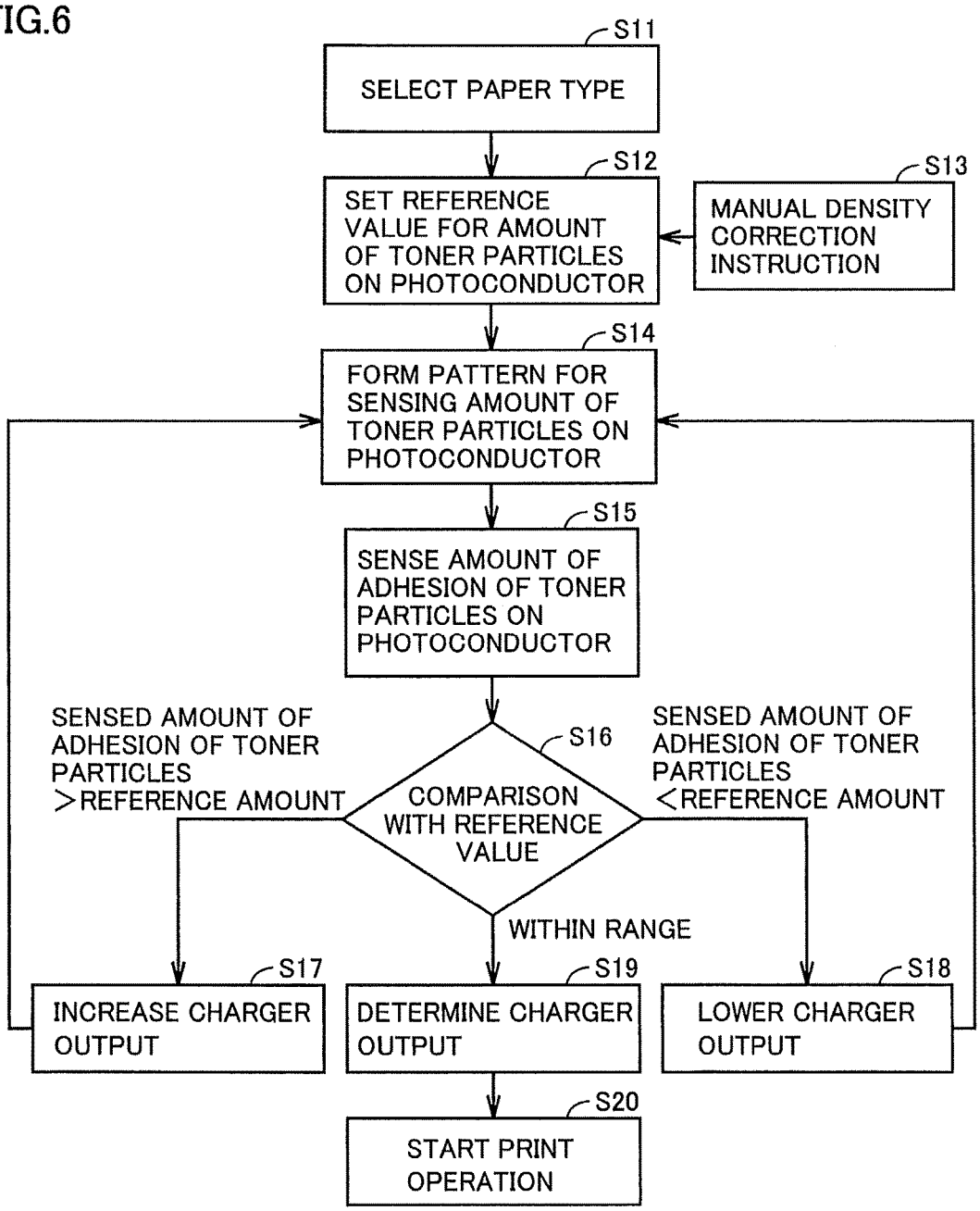
FIG. 6 is a diagram showing a flow of image formation by the wet type image forming apparatus in the first embodiment.
Figure 7:
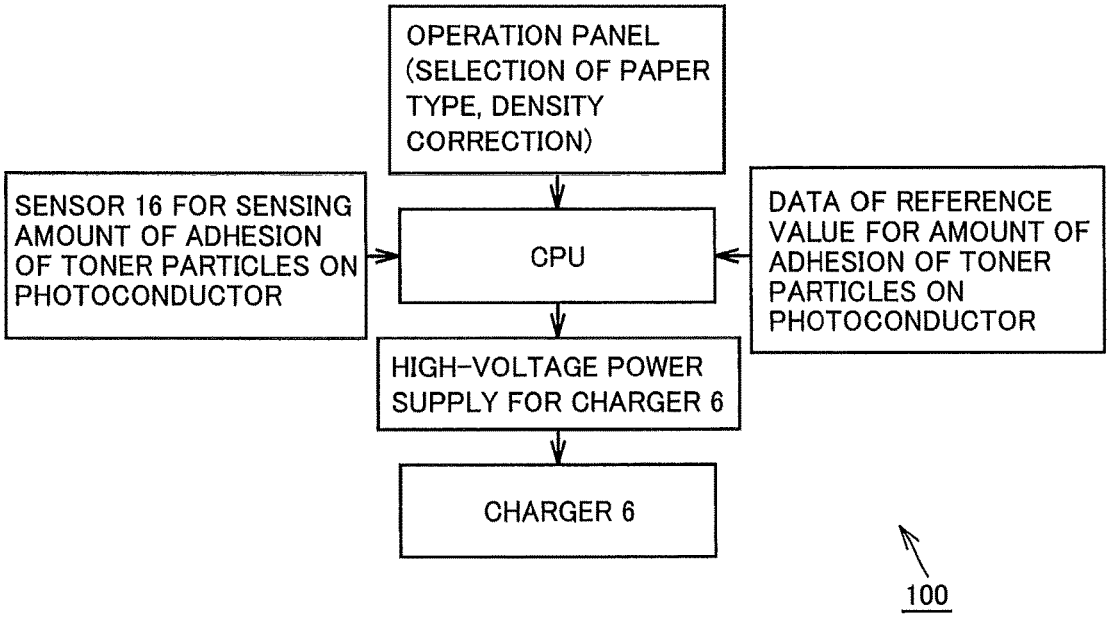
FIG. 7 is a diagram showing a partial configuration of a control unit of the wet type image forming apparatus in the first embodiment.

FIG. 6 is a diagram showing a flow of image formation by wet type image forming apparatus 1000 including the construction above and FIG. 7 is a diagram showing a partial configuration of the control unit of wet type image forming apparatus 1000.

Referring to FIG. 6, in step 11 (hereinafter referred to as S11; the same will apply hereinafter), a type of paper is selected. In S12, a reference value for an amount of toner on photoconductor 1 is set. From S13, a density correction instruction may manually be provided. In S14, a pattern for sensing an amount of toner particles is formed on photoconductor 1, In S15, adhesion of toner particles 41*a* on photoconductor 1 is sensed. An amount of adhesion of these toner particles 41*a* is sensed by toner adhesion amount sensor 16.

In S16, comparison with a reference value is made. As shown in FIG. 7, a result of sensing by toner adhesion amount sensor 16 is sent to the CPU of control unit 100 and compared with the reference value. The CPU has recorded reference values in accordance with types of paper, and a reference value in accordance with a type is set based on input from a sensor sensing a type of paper or from an operator.

When it is determined that an amount of adhesion of toner particles 41*a* on photoconductor 1 is smaller than the reference amount as a result of sensing by toner adhesion amount sensor 16, transition to S18 is made and control is carried out such that a current which flows from first charger 6 into supply roller 5 decreases. In contrast, when it is determined that an amount of adhesion of toner particles is greater than the reference amount, transition to S17 is made and control is carried out such that a current which flows from first charger 6 into supply roller 5 increases.

When it is determined in S16 that an amount of adhesion of toner particles 41*a* on photoconductor 1 is within a range of the reference value as a result of control of a current which flows from first charger 6 into supply roller 5, a value for a current which flows from first charger 6 into supply roller 5 is determined in S19 and a print operation by wet type image forming apparatus 1000 is started in S20.

By thus providing means for sensing an amount of adhesion of toner on photoconductor 1 and controlling a current which flows from first charger 6 on supply roller 5 into supply roller 5 based on a result of sensing, an amount of adhesion of toner on photoconductor 1 is controlled. Thus, an amount of toner particles 41*a* on photoconductor 1 can be controlled to be constant even when an amount of a wet type developer on supply roller 5 varies due to change in environment or when development efficiency varies due to fluctuation of photoconductor 1.

By providing means for sensing an amount of adhesion of toner on transfer target (paper) 15 as well, an amount of toner particles 41*a* on photoconductor 1 can be controlled and an amount of toner particles 41*a* on transfer target (paper) 15 can be controlled to be constant similarly to the above.

Second Embodiment

Figure 8:
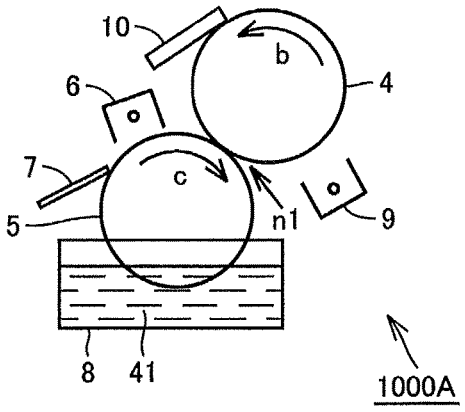
FIG. 8 is a diagram schematically showing a partial construction of a wet type image forming apparatus in a second embodiment.

A wet type image forming apparatus 1000A in a second embodiment will now be described with reference to FIG. 8. FIG. 8 is a diagram schematically showing a partial construction of wet type image forming apparatus 1000A in the present embodiment. A difference from wet type image forming apparatus 1000 in the first embodiment above is that a second charger 9 implementing a second charging member charging toner particles 41*a* is provided also on development roller 4. A construction is otherwise the same as that of wet type image forming apparatus 1000.

When toner particles 41*a* are charged on supply roller 5 and toner particles 41*a* are moved to development roller 4 owing to electric field, fogging is likely to occur in a background portion during development to photoconductor 1 due to change in environment, and increase in voltage of the background portion may be necessary in order to eliminate fogging.

As a voltage of the background portion is increased, a charge potential of photoconductor 1 should be made higher in accordance with a difference in potential of a print portion. Since a charging voltage of photoconductor 1 has the upper limit, in some cases, a difference in potential of the print portion cannot sufficiently be ensured.

In order to ensure sufficient difference in potential between the print portion and the background portion, second charger 9 implementing the second charging member charging toner particles 41*a* is provided on development roller 4. As shown in FIG. 8, second charger 9 is provided to be opposed to development roller 4, between portion n1 of nipping together with supply roller 5, photoconductor 1, and development portion E.

Figure 9:
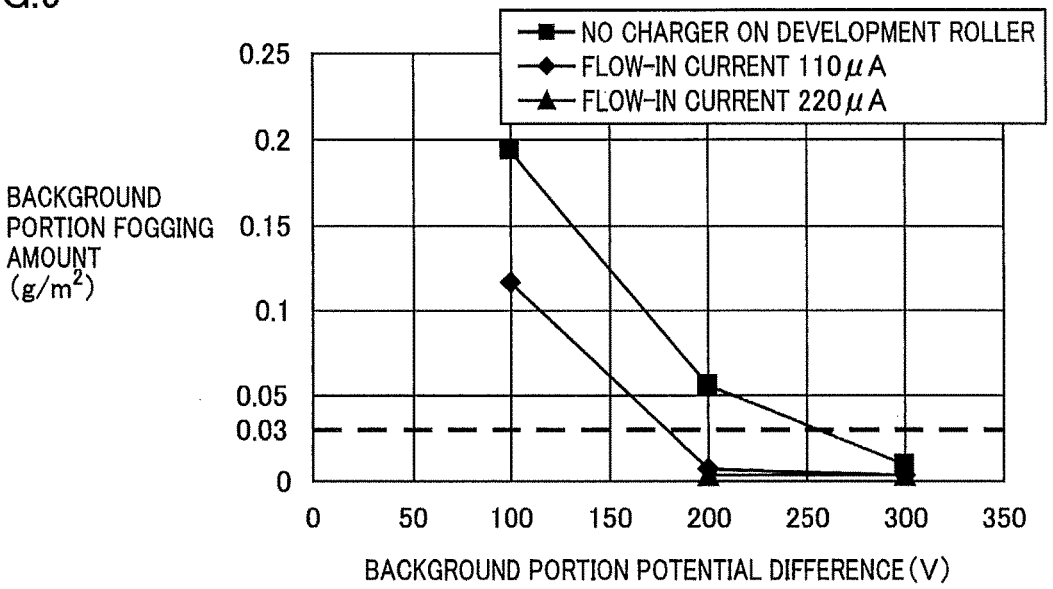
FIG. 9 is a diagram showing relation between a background portion potential difference and a background portion fogging amount of the wet type image forming apparatus in the second embodiment.

FIG. 9 shows relation between a background portion potential difference of photoconductor 1 (a difference between a charge potential of photoconductor 1 and a charge potential of development roller 4) and a background portion fogging amount when second charger 9 is provided on development roller 4. In the present experiment, a current which flows from first charger 6 into supply roller 5 is set to 220 μA and an amount of adhesion of toner on development roller 4 is set to 1.6 $g/m^2$. A background portion potential difference is varied by setting a voltage of development roller 4 to 400 V and varying a charge potential of photoconductor 1. An allowable amount of fogging on photoconductor 1 is 0.03 $g/m^2$, and it should be equal to or lower than that.

In a case that no charger is provided on development roller 4, in order to eliminate fogging of the background portion on photoconductor 1, a potential difference not less than 250 V is necessary. When toner particles are again charged by providing second charger 9 on development roller 4 and feeding a current to development roller 4, fogging of the background portion is lessened.

Specifically, when a current which flows from second charger 9 into development roller 4 is set to 110 μA or higher, fogging on the photoconductor is sufficiently less even though a background portion potential difference is set to 200 V. Consequently, the background portion potential difference can be decreased so that a charge potential of photoconductor 1 can be decreased or a potential difference of a print portion can be increased. A low charge potential of photoconductor 1 is advantageous for life of photoconductor 1.

Figure 10:
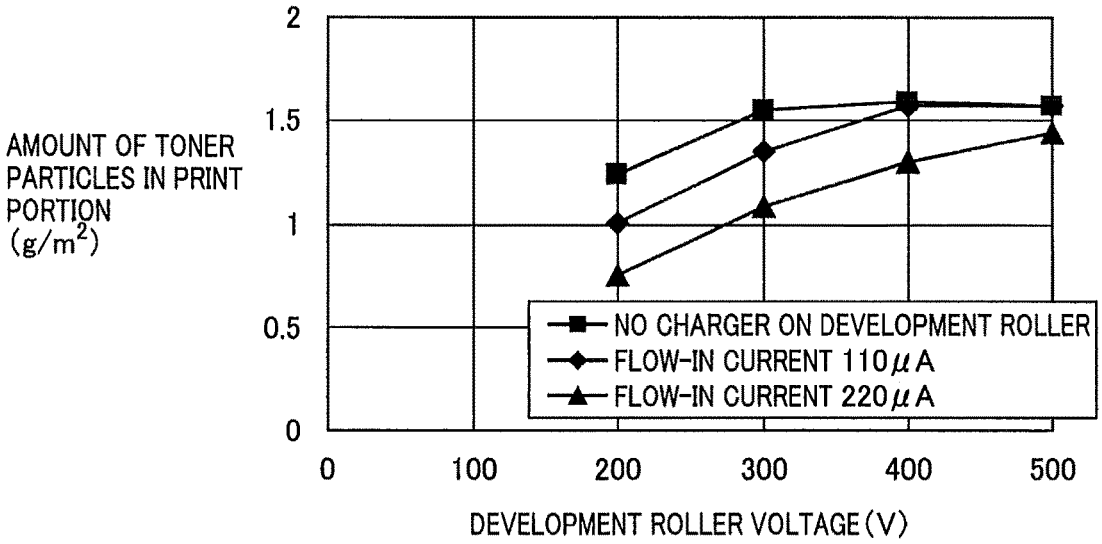
FIG. 10 is a diagram showing relation between a development roller voltage and an amount of toner particles in a print portion of the wet type image forming apparatus in the second embodiment.

FIG. 10 shows relation between a voltage of development roller 4 and an amount of toner particles in a print portion in a case that second charger 9 is provided. A voltage of supply roller 5 is also varied such that a difference in potential is 300 V with respect to a voltage of development roller 4.

As compared with a case that no second charger 9 is provided on development roller 4, in a case that toner particles are again charged by feeding a current from second charger 9 to development roller 4, an amount of toner particles on photoconductor 1 decreases. With a current which flows from second charger 9 of 220 μA, an amount of toner particles on photoconductor 1 decreases even when a development potential difference is set to 500 V.

As described above, when a current which flows from second charger 9 on development roller 4 into development roller 4 is too high, an amount of charge of toner particles 41*a* on development roller 4 is excessively large and toner particles are not sufficiently moved to (developed on) photoconductor 1. Therefore, a current which flows from second charger 9 into development roller 4 is desirably controlled such that an amount of charge of toner particles 41*a* on development roller 4 is not excessively large. In such a case, a current which flows from second charger 9 into development roller 4 is lower than a current which flows from first charger 6 into supply roller 5.

Though a current which flows from second charger 9 into development roller 4 may be constant, in a case that a current which flows from first charger 6 into supply roller 5 is varied, a current which flows from second charger 9 into development roller 4 may be controlled in accordance with a value thereof.

When a current which flows from first charger 6 into supply roller 5 is high, a current which flows from second charger 9 into development roller 4 is lowered, and when a current which flows from first charger 6 into supply roller 5 is low, a current which flows from second charger 9 into development roller 4 is made higher.

By doing so, a current which flows into toner particles 41*a* is kept within a constant range. Consequently, fluctuation in amount of charge of toner particles 41*a* is also less. When fluctuation in amount of charge of toner particles 41*a* is less, characteristics during transfer are also stabilized.

By thus charging toner particles 41*a* by using first charger 6 on supply roller 5 and thereafter charging again toner particles 41*a* by using second charger 9 on development roller 4, fogging of an image background portion can be lessened. In addition, a fogging potential difference can be decreased, so that a development potential difference can be increased or a charge potential of photoconductor 1 can be lowered. Consequently, both of fogging and an image (development) can more easily be achieved and life of photoconductor 1 can be extended.

Third Embodiment

Figure 11:
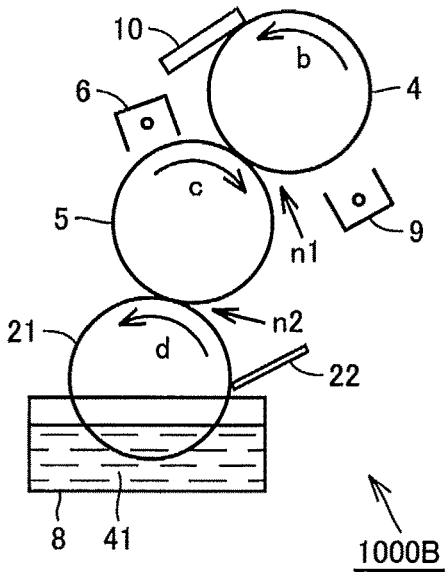
FIG. 11 is a diagram schematically showing a partial construction of a wet type image forming apparatus in a third embodiment.

A wet type image forming apparatus 1000B in a third embodiment will now be described with reference to FIG. 11. FIG. 11 is a diagram schematically showing a partial construction of wet type image forming apparatus 1000B in the present embodiment. A difference from wet type image forming apparatus 1000A in the second embodiment above is that an application roller 21 applying wet type developer 41 to supply roller 5 is provided. Restriction blade 7 is provided on supply roller 5 in wet type image forming apparatus 1000A, whereas a restriction blade 22 is provided on application roller 21 in wet type image forming apparatus 1000B in the present embodiment and no restriction blade is provided on supply roller 5. A construction is otherwise the same as that of wet type image forming apparatus 1000A in the second embodiment above.

An anilox roller having small recesses in a surface is employed as application roller 21. A part of application roller 21 is immersed in wet type developer 41 in developer tank 8. Application roller 21 abuts to supply roller 5 with constant force. Application roller 21 rotates in direction d in the figure at a linear velocity the same as supply roller 5.

Wet type developer 41 is brought up by rotation to application roller 21, and excessive wet type developer 41 is restricted by restriction blade 22 abutting to application roller 21. Wet type developer 41 is present only in recesses in application roller 21.

Application roller 21 holding wet type developer 41 only in the recesses owing to restriction blade 22 moves to a portion n2 of nipping together with supply roller 5 and passes wet type developer 41 to supply roller 5. A more accurate thin layer of wet type developer 41 can thus be formed on supply roller 5.

By thus using a roller having small recesses in a surface, an amount of toner particles 41*a* on supply roller 5 can accurately be controlled.

Though control of an amount of toner particles 41*a* on photoconductor 1 or what is called constant voltage control by controlling a value for a current which flows from first charger 6 into supply roller 5 is described in each embodiment above, a method of controlling output of first charger 6 is not limited to constant voltage control and a method of controlling a voltage (constant current control) can also be adopted. This is also the case with second charger 9.

According to the wet type image forming apparatus in each embodiment above, an amount of toner particles on a photoconductor can be controlled while occurrence of increase in torque and deterioration of members is prevented and a toner layer of a uniform film thickness is formed.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A wet type image forming apparatus for printing on a transfer target by using a wet type developer containing toner particles, comprising:

a developer carrier supplying said wet type developer to a latent image carrier having an electrostatic latent image formed;

a supply member supplying said wet type developer to said developer carrier;

said supply member having a surface rotating in a direction similar to a surface of said developer carrier at a similar peripheral velocity at a portion abutting to said developer carrier, and a control unit configured to produce a potential difference causing the toner particles to move from a supply side to a side of said developer carrier by forming an electric field between said developer carrier and said supply member; and a first charging member arranged at a position upstream from the portion of the supply member abutting to said developer carrier in a direction of rotation of said supply member, for charging said toner particles in a wet type developer layer formed by said wet type developer on said supply member;

said control unit controlling the potential difference between said developer carrier and said supply member and output of said first charging member, said control unit causing said toner particles on said supply member to move to said developer carrier by providing a potential difference between said developer carrier and said supply member, and controlling an amount of said toner particles on said latent image carrier by controlling output of said first charging member, and said control unit increases the amount of said toner particles on said latent image carrier by lowering output of said first charging member when surface irregularities of said transfer target have become coarse, wherein the control unit causes the toner particles on the supply member to move to the developer carrier by setting the voltage of the supply member to be at least 700 V, and controls the amount of the toner particles on the latent image carrier by controlling a current from the first charging member to the supply member to be in the range from 220 μA to 440 μA.

2. The wet type image forming apparatus according to claim 1, wherein output of said first charging member is controlled depending on a type of said transfer target used.

3. The wet type image forming apparatus according to claim 1, further comprising a sensing device sensing an amount of adhesion of said toner particles on said latent image carrier between a transfer portion where an image formed on said latent image carrier is transferred to said transfer target and a development portion where said wet type developer is supplied from said developer carrier to said latent image carrier, wherein said control unit controls output of said first charging member based on information obtained from said sensing device.

4. The wet type image forming apparatus according to claim 1, further comprising a second charging member charging said toner particles on said developer carrier.

5. The wet type image forming apparatus according to claim 1, wherein a potential difference causing said toner particles on said developer carrier at a position opposed to an image portion of said electrostatic latent image to entirely move to said latent image carrier is formed between said developer carrier and said latent image carrier.

6. The wet type image forming apparatus according to claim 1, wherein the potential difference is 400 V.

7. The wet type image forming apparatus according to claim 1, wherein said control unit increases an amount of said toner particles on said latent image carrier by decreasing a current which flows into said supply member from said first charging member by decreasing the output of said first charging member when the surface irregularities of said transfer target are rough.

* * * * *